US012460441B2

(12) United States Patent
Yang

(10) Patent No.: US 12,460,441 B2
(45) Date of Patent: Nov. 4, 2025

(54) DECORATIVE FENCE

(71) Applicant: Ping Yang, Dongguan (CN)

(72) Inventor: Ping Yang, Dongguan (CN)

( * ) Notice: Subject to any disclaimer, the term of this patent is extended or adjusted under 35 U.S.C. 154(b) by 492 days.

(21) Appl. No.: 18/054,365

(22) Filed: Nov. 10, 2022

(65) Prior Publication Data

US 2024/0159079 A1 May 16, 2024

(51) Int. Cl.
*E04H 17/00* (2006.01)
*E04H 17/14* (2006.01)
*E04H 17/20* (2006.01)

(52) U.S. Cl.
CPC ..... *E04H 17/017* (2021.01); *E04H 17/143* (2013.01); *E04H 17/21* (2021.01); *E04H 17/1452* (2021.01)

(58) Field of Classification Search
CPC ... E04H 17/017; E04H 17/14; E04H 17/1413; E04H 17/1417; E04H 17/1426; E04H 17/143; E04H 17/1447; E04H 17/1452; E04H 17/1465; E04H 17/1469; E04H 17/16; E04H 17/1602; E04H 17/165; E04H 17/17
See application file for complete search history.

(56) References Cited

U.S. PATENT DOCUMENTS 1,794,467 A * 3/1931 Lucas ..... F21V 33/006 256/33
3,902,703 A * 9/1975 Bouye ..... E04H 17/18 256/65.11
6,182,948 B1 * 2/2001 Brandeis ..... E04H 17/16 256/65.13
6,398,193 B1 * 6/2002 DeSouza ..... E04H 17/1488 256/65.06
10,392,829 B2 * 8/2019 Peter ..... E04H 17/16
10,746,387 B2 * 8/2020 Beausoleil ..... F21V 21/116
10,876,727 B1 * 12/2020 Xi ..... F21S 4/28
11,761,612 B1 * 9/2023 Wang ..... E04H 17/017 362/249.01

(Continued)

FOREIGN PATENT DOCUMENTS

CN 201991302 U 9/2011
CN 203022420 U * 6/2013

(Continued)

*Primary Examiner* — Jonathan P Masinick
(74) *Attorney, Agent, or Firm* — Sinorica International Patent & Trademark

(57) ABSTRACT

A decorative fence includes a fence body and at least two posts wherein the fence body includes multiple translucent boards orderly arranged, and every two translucent boards adjacent to each other are connected by a connection part; the translucent board has a hollow interior, and a light-emitting device is disposed in the hollow interior of the translucent board; the at least two posts are disposed on outer sides of the fence body, and are connected with the fence body; a power source is installed on the post, and the light-emitting device is electrically connected to the power source. As the existing fence lighting decoration is basically to hang or wrap around lighting chains over a fence and needs to provide power through power cords from a house, the present invention is convenient in deploying and prevents potential safety hazards for children touching the power cords inadvertently.

5 Claims, 6 Drawing Sheets

(56) References Cited

U.S. PATENT DOCUMENTS

| | | | | |
|---|---|---|---|---|
| 11,828,450 | B1 * | 11/2023 | Wang | F21V 23/002 |
| 2002/0000545 | A1 * | 1/2002 | Pettit | E04H 17/1439 256/19 |
| 2002/0023406 | A1 * | 2/2002 | Pettit | E04H 17/1417 52/832 |
| 2003/0075712 | A1 * | 4/2003 | Lin | E04H 17/017 256/1 |
| 2003/0164486 | A1 * | 9/2003 | West | E04F 11/181 256/65.1 |
| 2004/0104383 | A1 * | 6/2004 | Lin | E04H 17/16 256/67 |
| 2008/0084711 | A1 * | 4/2008 | Chen | F21V 21/0824 362/648 |
| 2008/0099751 | A1 * | 5/2008 | Chen | F21V 33/006 256/19 |
| 2013/0027914 | A1 * | 1/2013 | McCall | F21V 33/006 362/145 |
| 2021/0325031 | A1 * | 10/2021 | Wilson | E04H 17/20 |
| 2023/0417076 | A1 * | 12/2023 | Lizarraga | E04H 17/1448 |
| 2024/0295295 | A1 * | 9/2024 | Dickens | F21S 4/10 |

FOREIGN PATENT DOCUMENTS

| | | | | |
|---|---|---|---|---|
| CN | 212562766 | U | * | 2/2021 |
| CN | 113062655 | A | * | 7/2021 |
| DE | 9318762 | U1 | * | 5/1994 |
| KR | 20140006637 | A | * | 1/2014 |
| KR | 20150002700 | U | * | 7/2015 |

* cited by examiner

DECORATIVE FENCE

BACKGROUND OF THE INVENTION

1. Field of the Invention

The present invention relates to the technical field of fence, in particular to a decorative fence.

2. Description of the Related Art

Fences are often used to surround gardens, courtyards and other places. At present, there are many kinds of fences on the market, such as iron fences, plastic fences, and wooden fences. In order to make a fence more aesthetic and at the same time to create a special atmosphere at night, lighting decorations are commonly put on the fence.

The existing fence lighting decoration is basically to hang or wrap around lighting chains over a fence, which is not only inconvenient in deployment, but also needs to connect a power cord from a house to supply power to the lighting chains. Moreover, children tend to touch the power cord inadvertently when playing in the garden, which causes safety hazards. Therefore, it is necessary to provide a technical solution to solve the above problems.

SUMMARY OF THE INVENTION

In order to solve the above problems, the present invention provides a decorative fence including a fence body and at least two posts, wherein

- the fence body includes multiple translucent boards orderly arranged, among which every two said translucent boards adjacent to each other are connected by a respective connection part; each of the multiple translucent boards has a hollow interior, and each of the multiple translucent boards has a light-emitting device disposed in the hollow interior; and
- the at least two posts are respectively disposed on outer sides of the fence body and connected with the fence body;
- a power source is installed on at least one of the at least two posts, and the light-emitting device is electrically connected to the power source.

Preferably, the power source includes a solar charger, and the solar charger is installed on a top of the at least one of the at least two posts.

Preferably, a light sensor is installed on the at least one of the at least two posts, and the light sensor is electrically connected to the power source.

Preferably, the power source has a socket; a conductive wire is electrically connected to the light-emitting device, and an end of the conductive wire is provided with a plug matching the socket; when the socket and the plug are connected, the light-emitting device and the power source are electrically conducting.

Preferably, the light-emitting device includes a circuit board and a plurality of light emitting diode lamps installed thereon, and the conductive wire is electrically connected to the circuit board.

Preferably, a connection opening is formed inside the connection part, and the interiors of the every two said translucent boards adjacent to each other communicate via the connection opening; a plug is provided at an end of the fence body, and the conductive wire passes through the connection opening to connect to the plug.

Preferably, two sides of each of the multiple translucent boards each respectively have one said connection part provided thereon, the connection part on one of the two sides is provided with a connecting pin, and the connection part on the other one of the two sides is provided with a fixing hole; as the connecting pin on one of the multiple translucent boards is clamped into the fixing hole on one adjacent translucent board of the multiple translucent boards, the two adjacent translucent boards of the multiple translucent boards are connected.

Preferably, at least one of the at least two posts is provided with a receiving part, and a receiving opening is formed in the middle of the receiving part, and both sides of the receiving part each have a respective engaging hole formed outwardly thereon; and adjacent to the at least one of the at least two posts, one of the translucent boards has an inserting part, both sides of the inserting part each have a respective engaging protrusion disposed thereon; and said inserting part is configured to be inserted in said receiving opening with the two engaging protrusions respectively engaging in the two engaging holes.

The technical effects of the decorative fence related to the present invention are:

1. The present invention is provided with a light-emitting device inside a translucent board, thereby reducing a user's lighting chains deployment steps, providing convenience for the user, and as the light-emitting device is inside the translucent board, the light-emitting device is not susceptible to damages. Secondly, the present invention installs a power source on a post to directly supply power to a light-emitting device without using a power cord from a house, so that safety and aesthetics of a garden are improved.

2. The present application uses a solar charger as a power source. The solar charger absorbs solar energy during daytime and converts it into electric energy for storage. During nighttime, when the light sensor detects that ambient light is insufficient, the solar charger is driven to supply power to light up the light-emitting device. The present application is designed to reasonably use green solar energy, and by reducing electric energy consumption, the present application is more environmentally friendly.

DETAILED DESCRIPTION OF THE INVENTION

Figure 1:
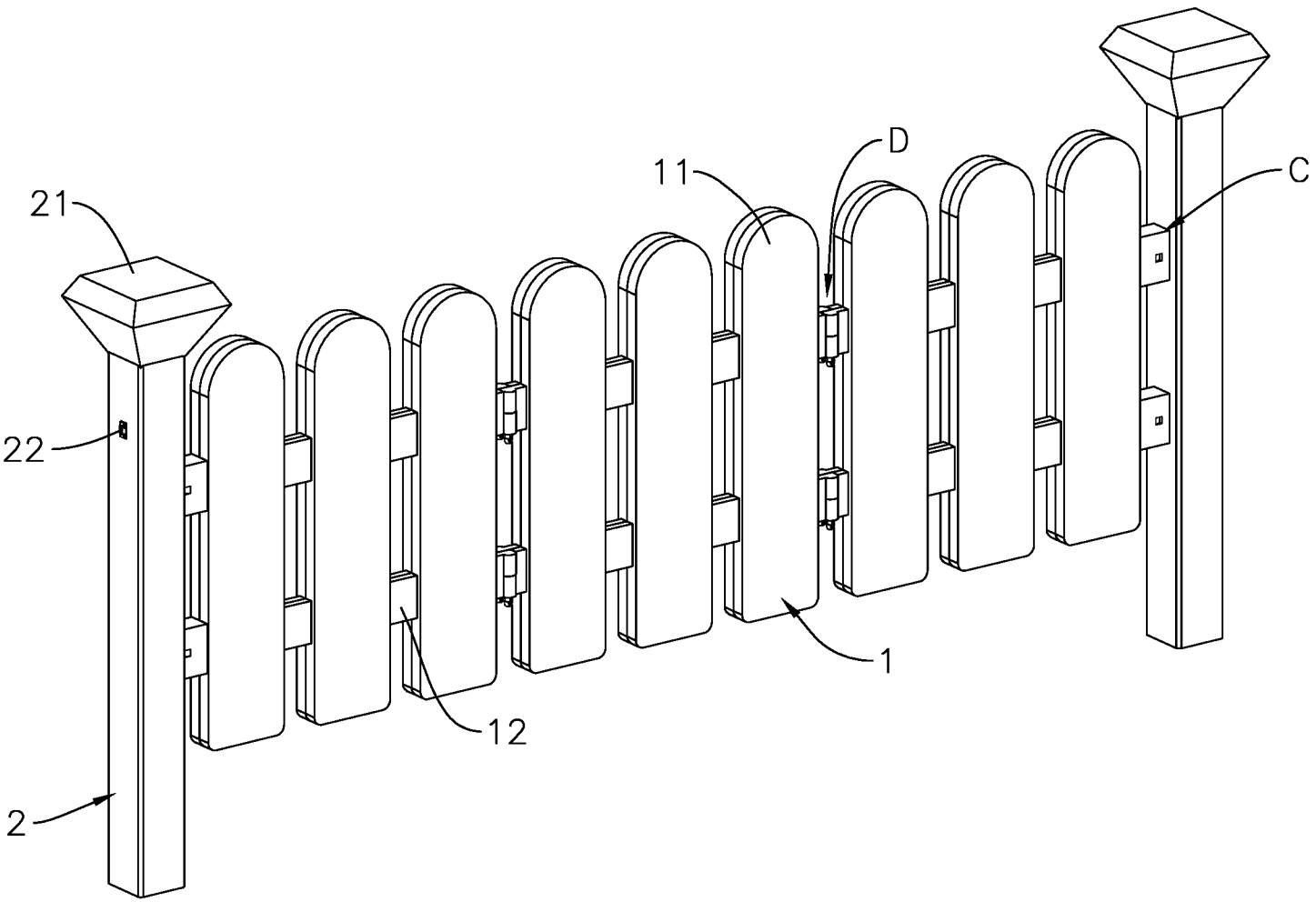
FIG. 1 shows structures of a decorative fence of the present invention.
Figure 2:
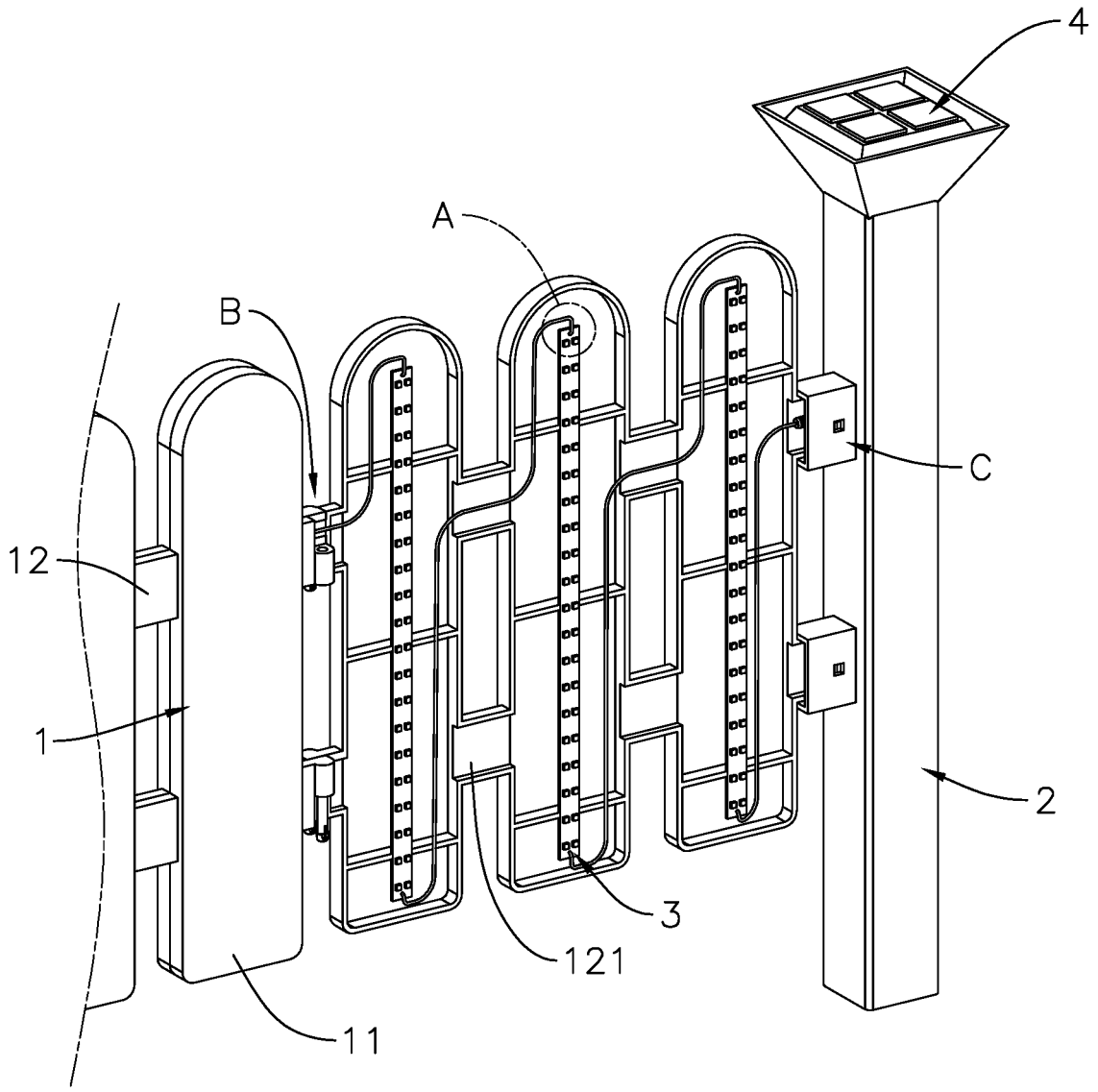
FIG. 2 shows a schematic diagram of internal structures of a translucent board in the decorative fence of the present invention.
Figure 3:
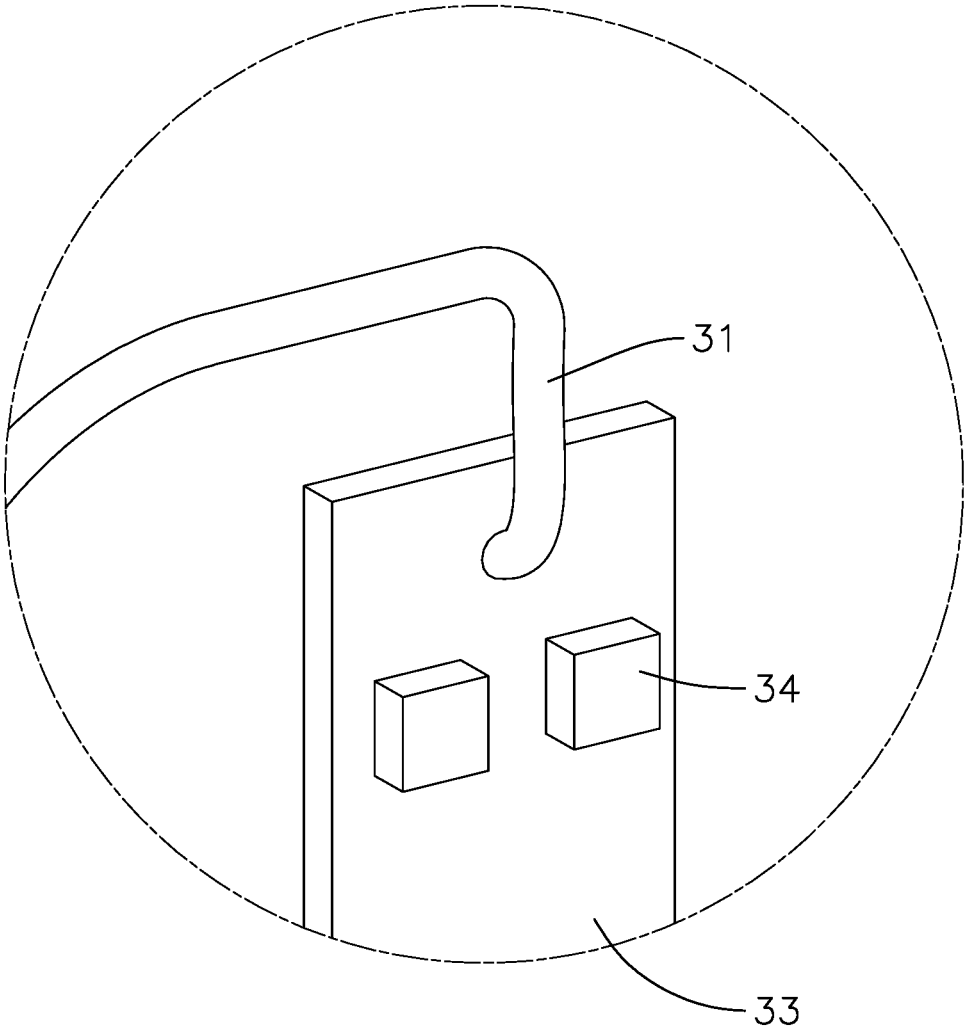
FIG. 3 shows an enlarged view of region A in FIG. 2.

In the following, the technical solutions in the embodiments of the present invention will be clearly and fully described with reference to the drawings in the embodiments of the present invention. Obviously, the described embodiments are only a part of, not all of, the embodiments of the present invention. Based on the embodiments of the present invention, all other embodiments obtained by a person of ordinary skill in the art without creative efforts shall fall within the protection scope of the present invention.

In order to illustrate technical solutions of the present invention more clearly, a preferred embodiment is provided below. Please refer to FIG. 1 to FIG. 5 for details. A decorative fence includes a fence body 1 and two posts 2, wherein:

The fence body 1 comprises several translucent boards 11 that are arranged in an orderly manner, and every two adjacent said translucent boards 11 are connected by a connection part 12; each translucent board 11 has a hollow interior having a space where a light-emitting device 3 is installed therein.

The two posts 2 are disposed on outer sides of the fence body 1 and are connected to the fence body 1; at least one of the two posts 2 is provided with a power source 4, and the light-emitting device 3 is electrically connected to the power source 4.

In this embodiment, a design of installing the light-emitting device 3 inside the translucent board 11 is adopted, thereby reducing lighting chains deployment steps, and thus improving conveniences for a user. As the light-emitting device 3 is installed inside the translucent board 11, the light-emitting device 3 is not easily susceptible to vandalism, and in the present application, the power source 4 is installed on at least one of the two posts 2 to directly supply power to the light-emitting device 3, therefore no need to connect power cords from a house, which improves aesthetics and safety for a garden, and the like.

In one embodiment, a fence body 1 is sandwiched between two posts 2, and a plurality of the posts 2 and sets of the fence bodies 1 can be incorporated to surround gardens, courtyards, and the like.

Preferably, the power source 4 includes a solar charger, and the solar charger is installed on a top of at least one of the two posts 2. The solar charger is used as the power source 4, so that the solar charger absorbs and converts solar energy into electric energy for storage during daytime, and during nighttime, the solar charger can thus provide electric energy to the light-emitting device 3 to generate light, thereby improving aesthetic effects of a fence. By reasonably using green solar energy, the design is environmentally friendly for reducing consumptions of electric energy.

As a preferred solution of this embodiment, the solar charger housing is provided with a translucent cover 21 which is installed on at least one of the two posts 2. The design of the translucent cover 21 not only ensures the solar charger to absorb solar energy normally, but also protects the solar charger from being damaged by collisions.

As a preferred solution of this embodiment, a light sensor 22 is installed on at least one of the two posts 2, and the light sensor 22 is electrically connected to the power source 4. Specifically, a controller (not shown in the drawings) is connected in series between the power source 4 and the light-emitting device 3, and the controller is electrically connected to the light sensor 22. The light sensor 22 is used to detect the intensity of ambient light, when the ambient light is dim, the light sensor 22 feeds back information to the controller, and then the controller controls the power source 4 to supply power to the light-emitting device 3, so that the light-emitting device 3 emits light. And when the light sensor 22 detects that the ambient light is bright, the controller controls the power source 4 to disconnect the power supply from the light-emitting device 3.

As a preferred solution of this embodiment, the power source 4 is provided with a socket 41; the light-emitting device 3 is electrically connected to a conductive wire 31, and an end of the conductive wire 31 is provided with a plug 32 that matches the socket 41. When the socket 41 and the plug 32 are electrically connected, the light-emitting device 3 and the power source 4 are electrically connected. Multiple light-emitting devices 3 are connected in series or in parallel through the conductive wire 31, and then electrically connected to the power source 4 through connection of the socket 41 and the plug 32, and when the power source 4 outputs electric energy, the multiple light-emitting devices 3 can light up simultaneously or sequentially. The user can control ON/OFF of the multiple light-emitting devices 3 through plugging/unplugging of the plug 32 into/from the socket 41. In this embodiment, the socket 41 extends to exterior of the post 2, and the plug 32 extends to exterior of the fence body 1, which is convenient for a user to plug/unplug the plug 32 into/from the socket 41.

As a preferred solution of the present embodiment, the light-emitting device 3 includes a circuit board 33 and multiple LED lamps 34, and the multiple LED lamps 34 are installed on the circuit board 33, and the conductive wire 31 is electrically connected to the circuit board 33. The deployment of the LED lamps 34 on the circuit board 33 can be configured into different lighting patterns, so as to meet various needs of users.

As another preferred solution, the light-emitting device 3 includes multiple LED lamps directly connected to the conductive wire 31; the conductive wire 31 and the LED lamps form a lighting chain, and the lighting chain is configured according to a specific lighting pattern. After the lighting chain is energized, the light generated by the multiple LED lamps can present the specific lighting pattern to improve the aesthetics of the fence.

As a preferred solution of this embodiment, a connection opening 121 is disposed inside the connection part 12, and the interiors of two adjacent said translucent boards 11 communicate with each other via the connection opening 121. The plug 32 is disposed at an end of the fence body 1, and the conductive wire 31 is inserted through the connection opening 121 and is connected to the plug 32. In the prior art, a lighting chain is designed to be wound around a fence as a decoration. Under the influence of external factors such as rain and strong wind, the circuit lines of a lighting chain is prone to damaging and aging. In this embodiment, a space of the connection opening 121 accommodates the conductive wire 31 completely inside the fence body 1, so that the conductive wire 31 is not easily aged and damaged, and the service life of the lighting module inside the decorative fence can be prolonged.

Figure 4:
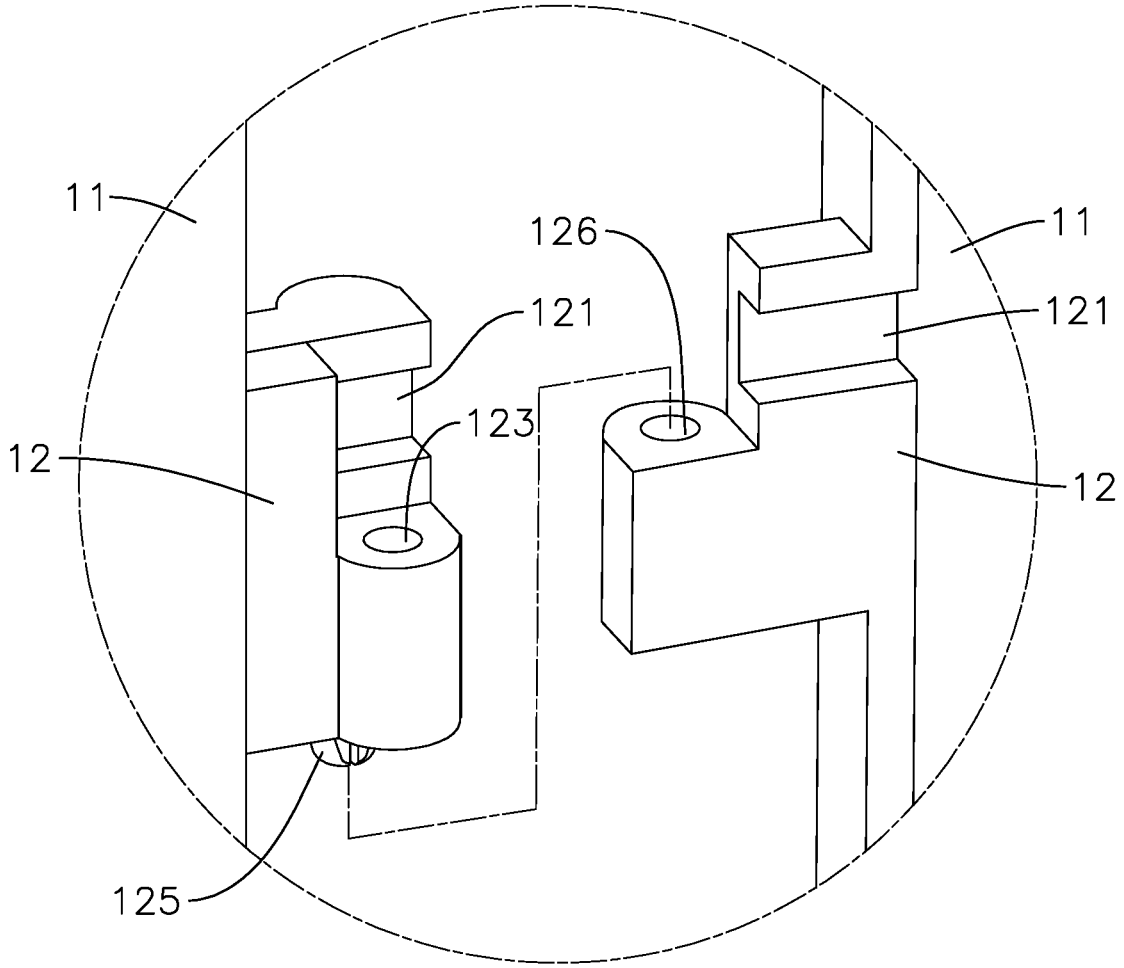
FIG. 4-5 show the structural diagram of a connecting pin and a fixing hole in the decorative fence of the present invention.
Figure 5:
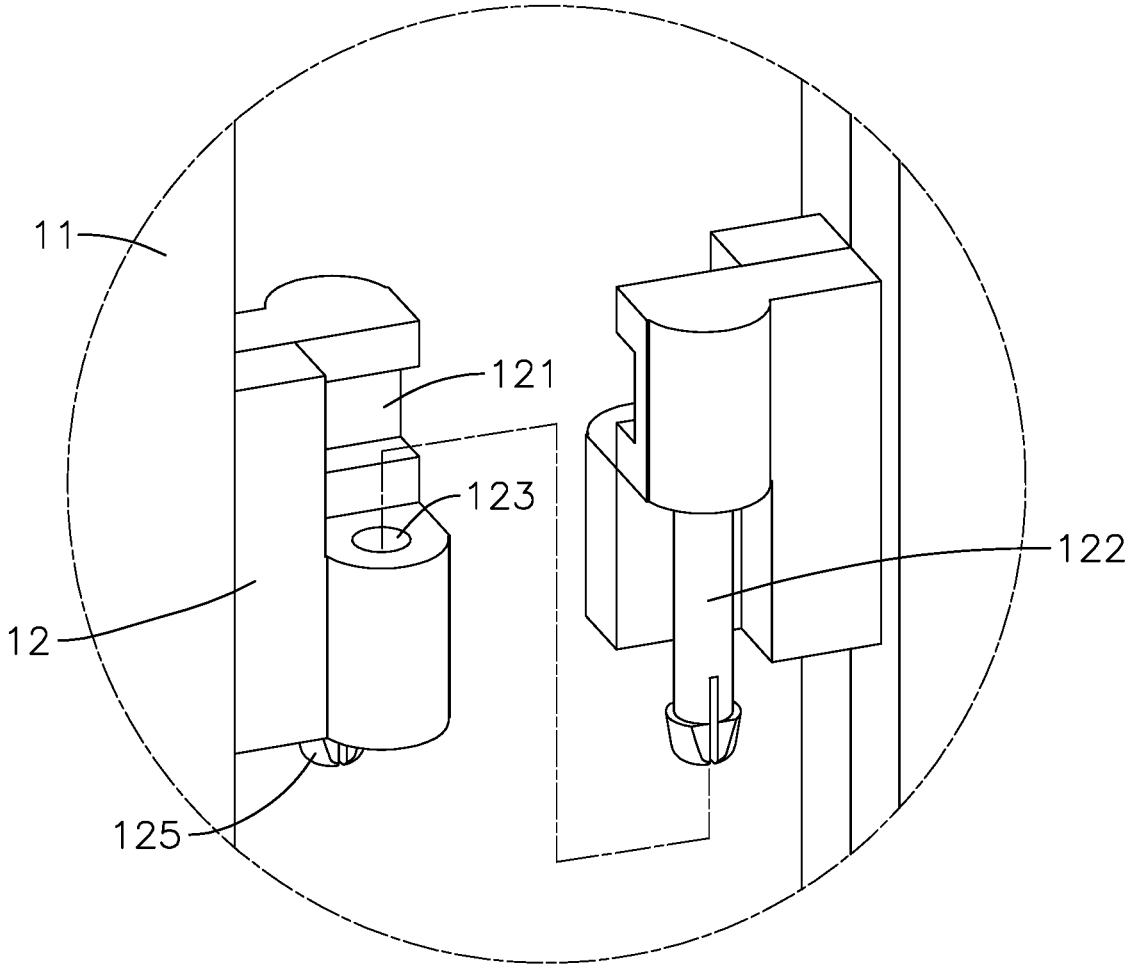

Please refer to FIG. 4. FIG. 4 shows a breakdown drawing of element B in FIG. 2. As a preferred solution of this embodiment, the connection parts 12 are provided on both sides of the translucent board 11. Two connection parts 12 are connected by utilizing a connecting pin 125 disposed on one side of a connection part 12 to clamp into a fixing hole 126 disposed on a corresponding side of another connection part 12, such that the connection parts 12 are connected; however at this point, the connection between the two connection parts 12 are only half done. Please refer to FIG. 5. FIG. 5 shows a breakdown drawing of element D in FIG. 1. Based on the settings of FIG. 4, FIG. 5 shows that the connecting bar 12 on one side of the connection part 12 is further provided with a fixing hole 123, and the connecting bar 12 on the corresponding side of said another connection part 12 is provided with a connecting pin 122, and the connecting pin 122 is then clamped into the fixing hole 123 to complete the connection between the two connection parts 12 and thereby the connection between the two transparent boards 11 is also completed. With the above design, the translucent boards 11 can be assembled and disassembled, and an overall length of the fence body 1 can be adjusted to meet various needs. It should be noted that after two translucent boards 11 are connected to each other, the connection openings 121 in the two connection parts 12 that are in contact with each other communicate to each other to facilitate deployment of the conductive wires 31.

Preferably, a plurality of the translucent boards 11 is set as a fence group. Each of the translucent boards 11 and each of the connection parts 12 in the fence group are injection-molded into one piece. The connecting pins 122, 125 and the fixing holes 123, 126 are respectively provided for the first and the last translucent boards 11 in the fence group and on the outer sides of the fence group. Compared with one-by-one assembling single translucent boards 11, the above design improves an assembling rate of the fence body 1, thereby improving an overall assembling rate of the decorative fence.

Specifically, in this embodiment, the fence group includes three translucent boards 11.

As a preferred solution of this embodiment, a housing of the translucent board 11 is composed of two shells that are fixedly connected, at least one of the two shells is provided with an accommodation space, and at least one of the two shells is provided with the connection part 12. The connection opening 121 inside the connection part 12 communicates with the accommodation space. When assembling the decorative fence, first of all, place the light-emitting device 3 in the accommodation space, and then configure the conductive wire 31 along the connection opening 121 of the connection part 12. After the above deployment is completed, the two shells are fixedly connected.

Preferably, the two shells are fixedly connected by ultrasonic welding.

Figure 6:
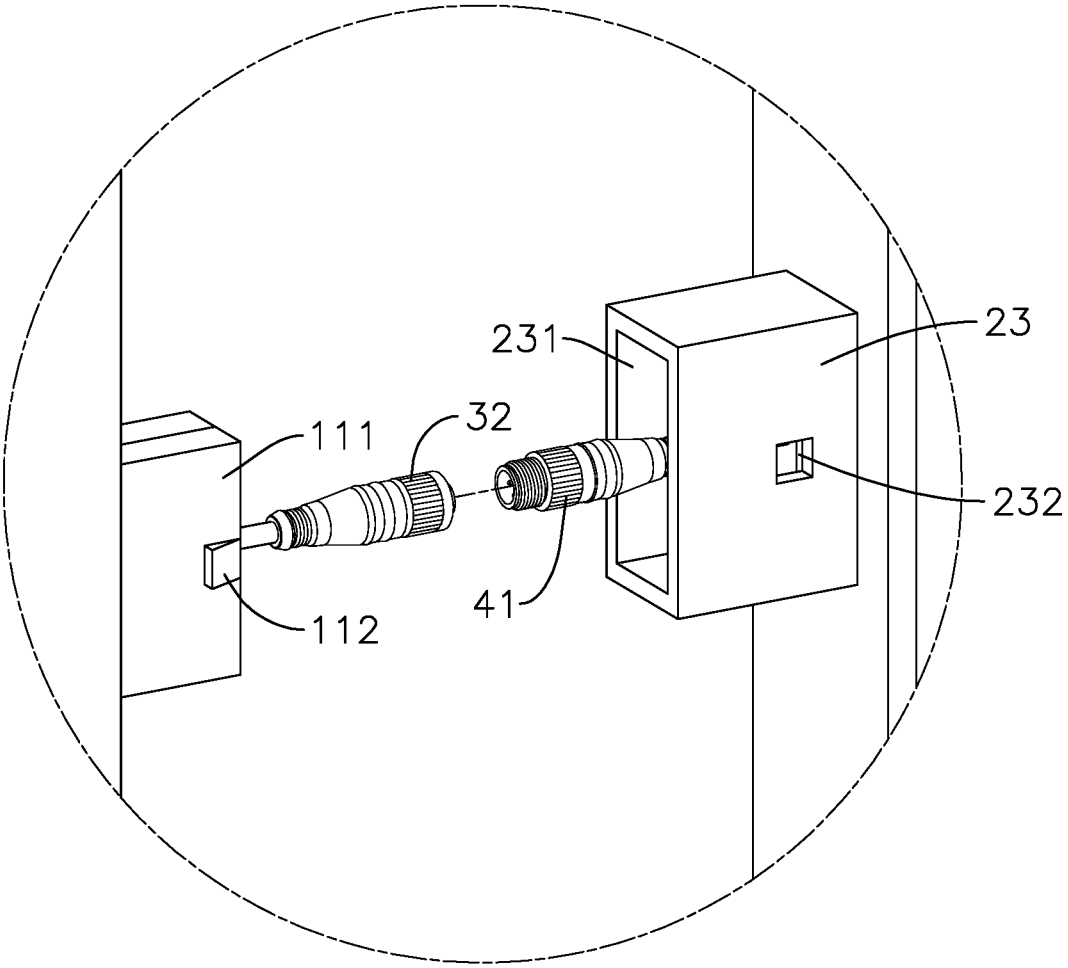
FIG. 6 shows a structural diagram of the inserting part and the receiving part in the decorative fence of the present invention.

Please refer to FIG. 6. FIG. 6 shows a breakdown drawing of element C in FIG. 1. As a preferred solution of this embodiment, a receiving part 23 is disposed on the post 2, a receiving opening 231 is formed in the middle of the receiving part 23, and both sides of the receiving part 23 each have a respective engaging hole 232 formed outwardly thereon. Adjacent to the post 2, one translucent board 11 has an inserting part 111, and both sides of the inserting part 111 each have a respective engaging protrusion 112 disposed thereon. The inserting part 111 is configured to be inserted in the receiving opening 231, with the two engaging protrusions 112 respectively engaging in the two engaging holes 232. The above design improves the installation convenience between the fence body 1 and the post 2.

Preferably, a control switch is connected to the above-mentioned controller, and the user can directly control the ON/OFF of the light-emitting device 3 through the control switch, lest a user should plug/unplug the plug 32 to/from the socket 41 to control the ON/OFF of the light-emitting device 3. Therefore, in this embodiment, the socket 41 protrudes out of the post 2 from the receiving opening 231; and a through hole is provided in the middle of the inserting part 111, and the plug 32 protrudes out of the fence body 1 from the through hole. In this way, the user can first connect the plug 32 and the socket 41, and then insert the inserting part 111 into the receiving opening 231, at this moment, the plug 32 and the socket 41 are placed in the through hole, so the inserting part 111 forms protection for the plug 32 and the socket 41, delays the aging of the plug 32 and the socket 41, and improves the service life of the plug 32 and the socket 41.

The decorative fence of the present invention solves the problem that the existing fence lighting decorations are basically to hang or wrap around lighting chains over a fence, which is not only inconvenient in deploying, but also needs to provide power to the lighting chains through power cords from a house. As children are prone to touch the power cords when playing in a garden and the like, such scenario poses a potential safety hazard.

The aforementioned are preferred embodiments of the present invention. It should be noted that for those of ordinary skill in the art, without departing from the principles of the present invention, certain improvements and retouches of the present invention can still be made, which are nevertheless considered as within the protection scope of the present invention.

What is claimed is:

1. A decorative fence including a fence body and at least two posts, wherein the fence body includes multiple translucent boards orderly arranged, among which every two said translucent boards adjacent to each other are connected by a respective connection part;

each of the multiple translucent boards has a hollow interior, and each of the multiple translucent boards has a light-emitting device disposed in the hollow interior; and the at least two posts are respectively disposed on outer sides of the fence body and connected with the fence body;

a power source is installed on at least one of the at least two posts, and the light-emitting device is electrically connected to the power source; wherein the power source has a socket; a conductive wire is electrically connected to the light-emitting device, and an end of the conductive wire is provided with a plug matching the socket; when the socket and the plug are connected, the light-emitting device and the power source are electrically conducting;

a connection opening is formed inside the connection part, and the interiors of the every two said translucent boards adjacent to each other communicate via the connection opening; the plug is provided at an end of the fence body, and the conductive wire passes through the connection opening to connect to the plug;

two sides of each of the multiple translucent boards each respectively have one said connection part provided thereon, the connection part on one of the two sides is provided with a connecting pin, and the connection part on the other one of the two sides is provided with a fixing hole; as the connecting pin on one of the multiple translucent boards is clamped into the fixing hole on one adjacent translucent board of the multiple translucent boards, the two adjacent translucent boards of the multiple translucent boards are connected.

2. The decorative fence as claimed in claim 1, wherein the power source includes a solar charger, and the solar charger is installed on a top of the at least one of the at least two posts.

3. The decorative fence as claimed in claim 1, wherein a light sensor is installed on the at least one of the at least two posts, and the light sensor is electrically connected to the power source.

4. The decorative fence as claimed in claim 1, wherein the light-emitting device includes a circuit board and a plurality of light emitting diode lamps installed thereon, and the conductive wire is electrically connected to the circuit board.

5. The decorative fence as claimed in claim 1, wherein at least one of the at least two posts is provided with a receiving part, and a receiving opening is formed in the middle of the receiving part, and both sides of the receiving part each have a respective engaging hole formed thereon; and adjacent to the at least one of the at least two posts, one of the translucent boards has an inserting part, both sides of the inserting part each have a respective engaging protrusion formed thereon; and said inserting part is configured to be inserted in said receiving opening with the two engaging protrusions respectively engaging in the two engaging holes.

* * * * *